US012426721B2

(12) United States Patent
Li et al.

(10) Patent No.: US 12,426,721 B2
(45) Date of Patent: Sep. 30, 2025

(54) TURNOVER MECHANISM, CRIB FRAME, AND FOLDABLE CRIB

(71) Applicant: Sichuan Hobbies Baby Products Co., Ltd., Neijiang (CN)

(72) Inventors: Jiagui Li, Neijiang (CN); Maoyuan Tian, Neijiang (CN)

(73) Assignee: Sichuan Hobbies Baby Products Co., Ltd., Neijiang (CN)

( * ) Notice: Subject to any disclaimer, the term of this patent is extended or adjusted under 35 U.S.C. 154(b) by 195 days.

(21) Appl. No.: 18/485,805

(22) Filed: Oct. 12, 2023

(65) Prior Publication Data

US 2024/0423387 A1 Dec. 26, 2024

(30) Foreign Application Priority Data

Jun. 25, 2023 (CN) ..... 202310746016.6

(51) Int. Cl.
*A47D 9/00* (2006.01)

(52) U.S. Cl.
CPC ..... *A47D 9/005* (2013.01)

(58) Field of Classification Search
CPC ..... A47D 7/00; A47D 7/002; A47D 7/005; A47D 7/007; A47D 7/01; A47D 7/04; A47D 9/00; A47D 9/005; A47D 9/008; A47D 9/012; A47D 9/016; A47D 9/02; A47D 9/04; A47D 9/053; A47D 11/00; A47D 11/005; A47D 11/007; A47D 13/06; A47D 13/061; A47D 13/063; A47D 13/065; A47D 13/066; A47D 13/068

See application file for complete search history.

(56) References Cited

U.S. PATENT DOCUMENTS

| | | | | |
|---|---|---|---|---|
| 6,473,919 | B1 * | 11/2002 | Wang | A47D 13/063 5/98.1 |
| 8,069,533 | B2 * | 12/2011 | Yu | A47D 13/063 5/99.1 |
| 11,589,685 | B2 * | 2/2023 | Bastien | E05D 11/1007 |
| 11,864,667 | B1 * | 1/2024 | Zhang | A47D 9/005 |
| 2009/0193581 | A1 * | 8/2009 | Cheng | A47D 13/063 5/99.1 |
| 2010/0260536 | A1 * | 10/2010 | Yu | A47D 13/063 5/99.1 |
| 2013/0232688 | A1 * | 9/2013 | Mendes | A47D 13/061 5/99.1 |

(Continued)

*Primary Examiner* — George Sun

(57) ABSTRACT

The present invention belongs to the technical field of cribs. The present invention discloses a turnover mechanism, a crib frame, and a foldable crib. The turnover mechanism comprises: a central seat of which a center of a bottom is provided with a support shaft; a plurality of sets of connecting members arranged around the central seat and pivotally connected to the central seat, wherein a gear portion is provided at one end that is of the connecting member and that is pivotally connected to the central seat; and a sliding member sleeved on the support shaft, wherein the sliding member is provided with a rack portion engaged with the gear portion. The foldable crib frame and the foldable crib can achieve synchronous rotation of a plurality of connecting members through the cooperation of the gear portion and the rack portion of the turnover mechanism, thereby facilitating rapid unfolding and folding.

15 Claims, 13 Drawing Sheets

(56) References Cited

U.S. PATENT DOCUMENTS

| | | | | |
|---|---|---|---|---|
| 2016/0338506 | A1* | 11/2016 | Yang | A47D 13/063 |
| 2017/0280892 | A1* | 10/2017 | Zhang | A47D 13/063 |
| 2020/0281369 | A1* | 9/2020 | Juchniewicz | A47D 13/063 |
| 2022/0296007 | A1* | 9/2022 | Mao | A47D 13/063 |

* cited by examiner

TURNOVER MECHANISM, CRIB FRAME, AND FOLDABLE CRIB

TECHNICAL FIELD

The present invention belongs to the technical field of cribs, and particularly relates to a turnover mechanism, a crib frame, and a foldable crib.

BACKGROUND

As an important auxiliary tool for caring for infants and young children, cribs are commonly used in many families around the world. Among them, the foldable crib has been widely used in recent years due to its characteristics of convenient storage and portability.

A folding crib frame part of the existing foldable crib generally comprises a bottom frame and guardrails. For the bottom frame, some existing technologies are to design the bottom frame as a turnover mechanism for folding and accommodation, including a central seat and bottom bars hinged around the central locking seat.

However, when the foldable crib is unfolded, the bottom bars are difficult to be unfolded due to uneven stress, abrasion, and the like, consequently, the foldable crib has undesirable phenomena such as sticking when being unfolded.

SUMMARY

In view of the foregoing problem that the existing foldable crib has difficulty in unfolding the bottom bars, which affects the unfolding operation of the foldable crib. One of the objectives of the present invention is to provide a turnover mechanism, a crib frame, and a foldable crib, which is easy to be unfolded and folded.

To achieve the above objective, the present invention uses the following technical solutions.

A turnover mechanism has an unfolding state and a turnover state, and comprises a central seat of which a center of a bottom is provided with a support shaft; a plurality of sets of connecting members arranged around the central seat and pivotally connected to the central seat, wherein a gear portion is provided at one end that is of the connecting member and that is pivotally connected to the central seat; and a sliding member sleeved on the support shaft and moving up and down along the support shaft, wherein the sliding member is provided with a rack portion engaged with the gear portion.

In one embodiment of the present invention, the turnover mechanism further comprises a locking member having a locking position and an unlocking position, wherein when in the locking position, the locking member can prevent the sliding member from moving, and when in the unlocking position, the sliding member can move along the support shaft; and an unlocking member connected to the locking member so as to switch the locking member between the locking position and the unlocking position.

In one embodiment of the present invention, the support shaft has an accommodating cavity, and the locking member comprises:

a plurality of rotating pieces centrally symmetrically arranged inside the support shaft and pivotally connected to the support shaft, wherein when in the locking position, the rotating piece partially penetrates through the support shaft and abuts against the sliding member, and when in the unlocking position, the rotating piece can rotate under the action of the unlocking member and be completely accommodated in the accommodating cavity.

In one embodiment of the present invention, the unlocking member comprises: a blocking piece slidably mounted in the accommodating cavity and abutting against a side surface of a top of the rotating piece so as to prevent the rotating piece from rotating; a lifting portion arranged at the top of the central seat, penetrating through the top of the central seat and connected to the blocking piece; and a first reset piece connected to the blocking piece.

The blocking piece extends downwards along two sides of the rotating piece to form extending portions; the rotating piece is provided with a chute; and the chute is provided with a pivot in a penetrating mode, and two ends of the pivot are connected to the extending portion, respectively.

In one embodiment of the present invention, the locking member comprises a second reset member connected to the sliding member.

The present invention further discloses a crib frame that has a usage state and a folding state, comprises an upright post and a handrail folded mechanism connected to the upright post, and further comprises the turnover mechanism according to any one of the technical solutions and a bottom bar connecting the turnover mechanism and the upright post.

The connecting members correspond to the upright posts one by one; and one end of the bottom bar is hinged to the upright post, and the other end of the bottom bar is connected to the connecting member.

In one embodiment of the present invention, the handrail folded mechanism comprises a joint; and two cross bars, wherein one end of the cross bar is pivotally connected to the upright post, and the other end of the cross bar is pivotally connected to the connecting member.

The cross bar can change the crib frame from a usage state to a folding state under the action of the turnover mechanism.

In one embodiment of the present invention, two sides of the joint are provided with accommodating cavities used to accommodate the other ends of the cross bars; inclined guide grooves are symmetrically provided at two sides of the accommodating cavity; an inclined upper end of the inclined guide groove is provided with a transversely communicated clamping and locking groove; and the other end of the cross bar is provided with a positioning portion that can move in the inclined guide groove and the clamping and locking groove.

When the crib frame needs to be folded, the upright post can pull the positioning portion from the clamping and locking groove to the inclined guide groove in an inclining process so as to rotate the cross bar, so that the foldable crib can be folded.

In one embodiment of the present invention, two sides of the accommodating cavity are provided with reinforcing rib plates, and the inclined guide groove and the clamping and locking groove are arranged at one surface that is of the reinforcing rib plate and that is opposite to the other reinforcing rib plate.

In one embodiment of the present invention, two sides of the accommodating cavity are further symmetrically provided with horizontal guide grooves; and the other end of the cross bar is provided with a pivot shaft, and the pivot shaft penetrates through the horizontal guide groove.

In one embodiment of the present invention, a first balance bar is provided below the cross bar; and one end of the first balance bar is hinged to the upright post, and the other end of the first balance bar is hinged to the joint.

In one embodiment of the present invention, the joint is provided with an arc-shaped guide groove; an upper end of the arc-shaped guide groove is provided with a transversely communicated limiting groove; and the other end of the first balance bar is provided with a pivot that is movable and penetrates through the arc-shaped guide groove or the limiting groove.

In one embodiment of the present invention, a second balance bar is provided below the bottom bar, one end of the second balance bar is hinged to the upright post, and the other end of the second balance bar is hinged to the support shaft.

In one embodiment of the present invention, the second balance bar is provided in a plurality of sections and connected to the bottom bar by a movable buckle.

In one embodiment of the present invention, a caster is formed at a lower end of the upright post.

In one embodiment of the present invention, the crib frame further comprises a plurality of auxiliary struts; and one end of the auxiliary strut is hinged to the central seat, and the other end of the auxiliary strut is formed into a free end.

A foldable crib having the crib frame according to any one of the technical solutions.

It can be learned from the foregoing descriptions that, compared with the prior art, the present invention has the following beneficial effects.

The present invention has a simple structure and a convenient operation, can achieve synchronous rotation of the connecting members through the cooperation of the gear portion and the rack portion, is convenient to be unfolded and folded, and can avoid undesirable phenomena such as sticking.

BRIEF DESCRIPTION OF DRAWINGS

To more clearly illustrate the technical solutions in the embodiments of the present invention or in the prior art, the drawings needed to be used in the description of the embodiments or the related technologies are briefly introduced below. It is obvious that the drawings in the description below are some embodiments of the present invention, and those of ordinary skill in the art can obtain other drawings according to the drawings provided herein without creative efforts.

Figure 1:
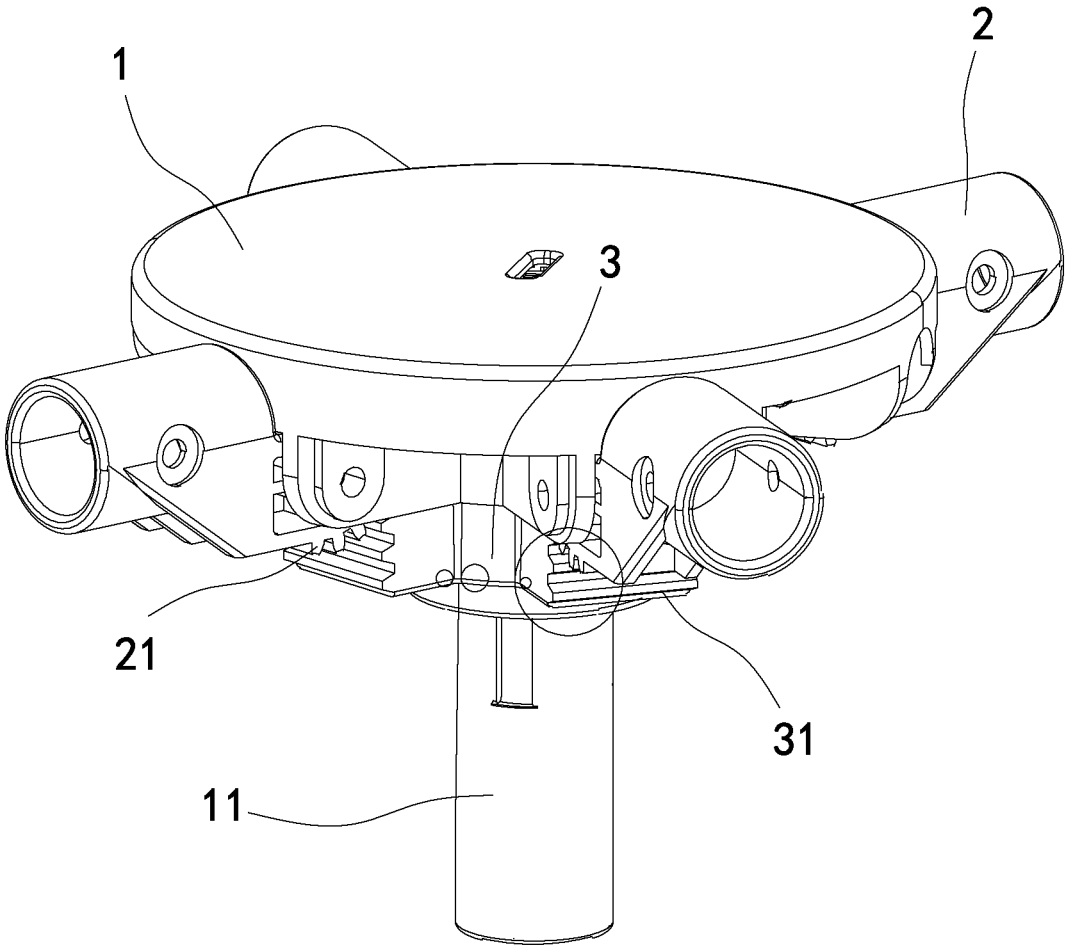
FIG. 1 is a schematic diagram of a structure of a turnover mechanism according to the present invention in an unfolding state.

Reference numerals are as follows:

1: central seat; 11: support shaft;
2: connecting member; 21: gear portion;
3: sliding member; 31: rack portion; 32: second reset member;
4: locking member; 41: rotating piece; 411: chute;
5: unlocking member; 51: blocking piece; 511: extending portion; 52: lifting portion; 53: first reset member;
6: upright post; 61: support foot; 62: corner seat;
7: handrail folded mechanism; 71: joint; 711: inclined guide groove; 712: clamping and locking groove; 713: horizontal guide groove; 714: reinforcing rib plate; 715: arc-shaped guide groove; 72: cross bar; 73: first balance bar;
8: bottom bar; 81: second balance bar; 82: movable buckle; and
9: auxiliary strut.

DETAILED DESCRIPTION OF EMBODIMENTS

In the following, only some exemplary embodiments are briefly described. As those skilled in the art would realize, the described embodiments may be modified in various different ways without departing from the spirit or scope of the present invention. Accordingly, the drawings and descriptions are to be regarded as illustrative in nature and not as restrictive.

In the description of the present invention, it should be understood that directions or positional relationships indicated by the terms "center", "longitudinal", "lateral", "length", "width", "thickness", "upper", "lower", "front", "rear", "left", "right", "vertical", "horizontal", "top", "bottom", "inner", "outer", "clockwise", "counterclockwise", "axial", "radial", "circumferential", and the like are those shown based on the accompanying drawings, and are merely intended to facilitate and simplify description rather than indicate or imply that the indicated apparatus or element must have a specific direction and must be configured and operated according to the specific direction. Therefore, these directions or positional relationships should not be construed as limiting the present invention.

Furthermore, the terms "first" and "second" are merely intended for a purpose of description, and shall not be understood as an indication or implication of relative importance or an implicit indication of a quantity of indicated technical features. Therefore, a feature defined with "first" or "second" may explicitly or implicitly include one or more features. In the description of the present invention, "a plurality of" means two or more unless specifically limited otherwise.

In the present invention, unless otherwise clearly specified and defined, the terms "install", "link", "connect", "fix", and the like should be understood broadly. For example, the term "connect" may be a fixed connection, may be a detachable connection, or may be integration; may be a direct connection, may be an indirect connection implemented by using an intermediate medium, or may be communication inside two elements or an interaction relationship between two elements. Those of ordinary skill in the art may understand specific meanings of the above terms in the present invention according to a specific condition.

In the present invention, unless otherwise specified and limited, when a first feature is "above" or "below" a second feature, the first feature may be in direct contact with the second feature, or the first feature may be in indirect contact with the second feature rather through another feature between them. In addition, that the first feature is "above", "over", or "on" the second feature may be that the first feature is right above and obliquely above the second feature, or merely mean that a horizontal height of the first feature is greater than that of the second feature. That the first feature is "below", "under", or "underneath" the second feature may be that the first feature is right below and obliquely below the second feature, or merely mean that a horizontal height of the first feature is less than that of the second feature.

The following describes embodiments of the present invention in detail with reference to accompanying drawings.

Embodiment 1

Figure 2:
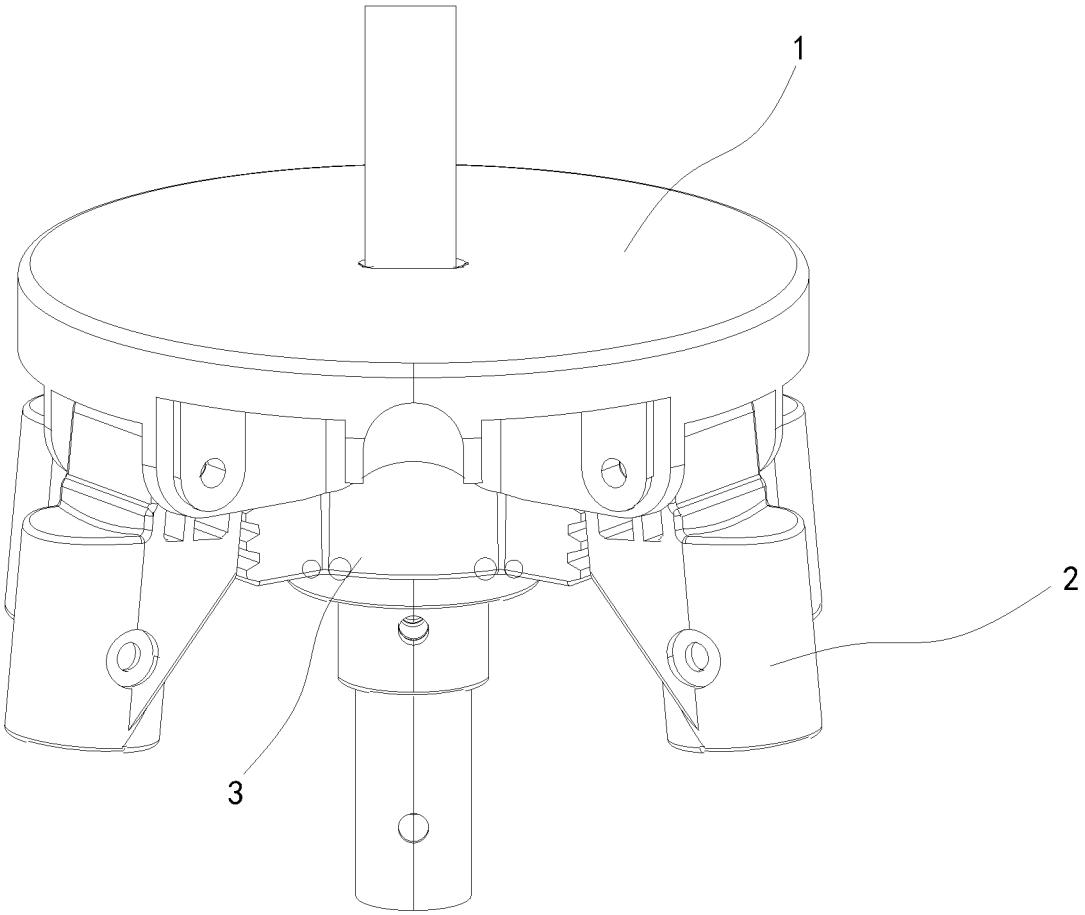
FIG. 2 is a schematic diagram of a structure of a turnover mechanism according to the present invention in a turnover state.

An embodiment of the present invention discloses a turnover mechanism that has an unfolding state shown in FIG. 1 and a turnover state shown in FIG. 2 and structurally comprises a central seat 1, a connecting member 2, and a sliding member 3.

Specifically, a center of a bottom of the central seat 1 is provided with a support shaft 11 extending downward.

The connecting member 2 is arranged around the central seat 1 and pivotally connected to the central seat 1, and a gear portion 21 is arranged at one end that is of the connecting member 2 and that is pivotally connected to the central seat 1.

The sliding member 3 is sleeved on the support shaft 11 and can move up and down along the support shaft 11, and the sliding member 3 is provided with a rack portion 31 engaged with the gear portion 21.

When the turnover mechanism is switched between the unfolding state and the turnover state, the plurality of sets of connecting members 2 can be simultaneously rotated, unfolded or turned over through the cooperation of the rack portion 31 and the gear portion 21, so that the folding and unfolding actions can be quickly and simply completed, and the phenomena of sticking and the like are avoided.

In this embodiment, four connecting member 2 are provided. It may be appreciated that a number of connecting members 2 may also be 2, 3, 5, and the like.

Figure 3:
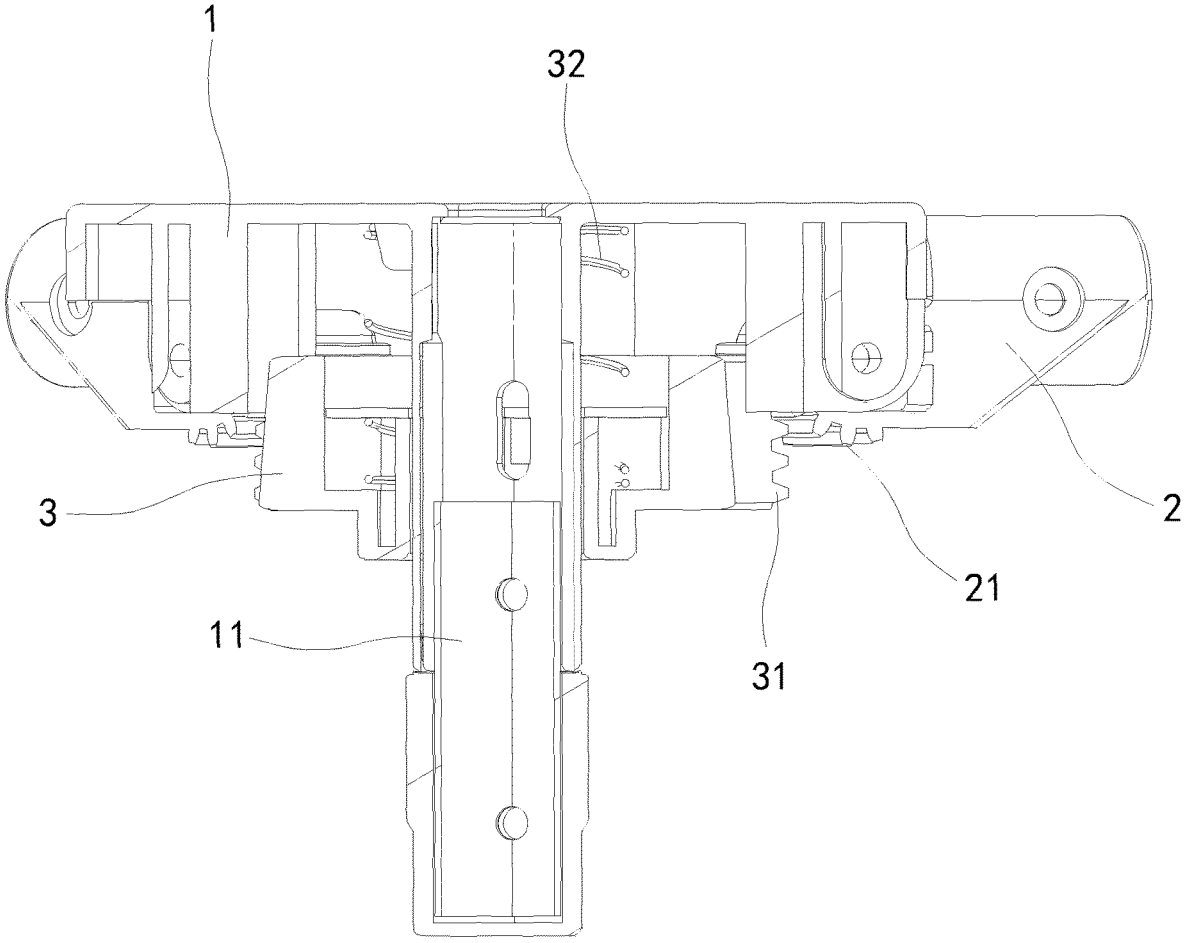
FIG. 3 is a schematic diagram of a structure of a longitudinal section of a turnover mechanism according to the present invention.

More specifically, in some embodiments, as shown in FIG. 3, a second reset member 32 is further included, wherein the second reset member is connected to the sliding member 3 to prevent the sliding member 3 from moving upward, so as to maintain the turnover mechanism in the unfolding state.

Embodiment 2

Figure 4:
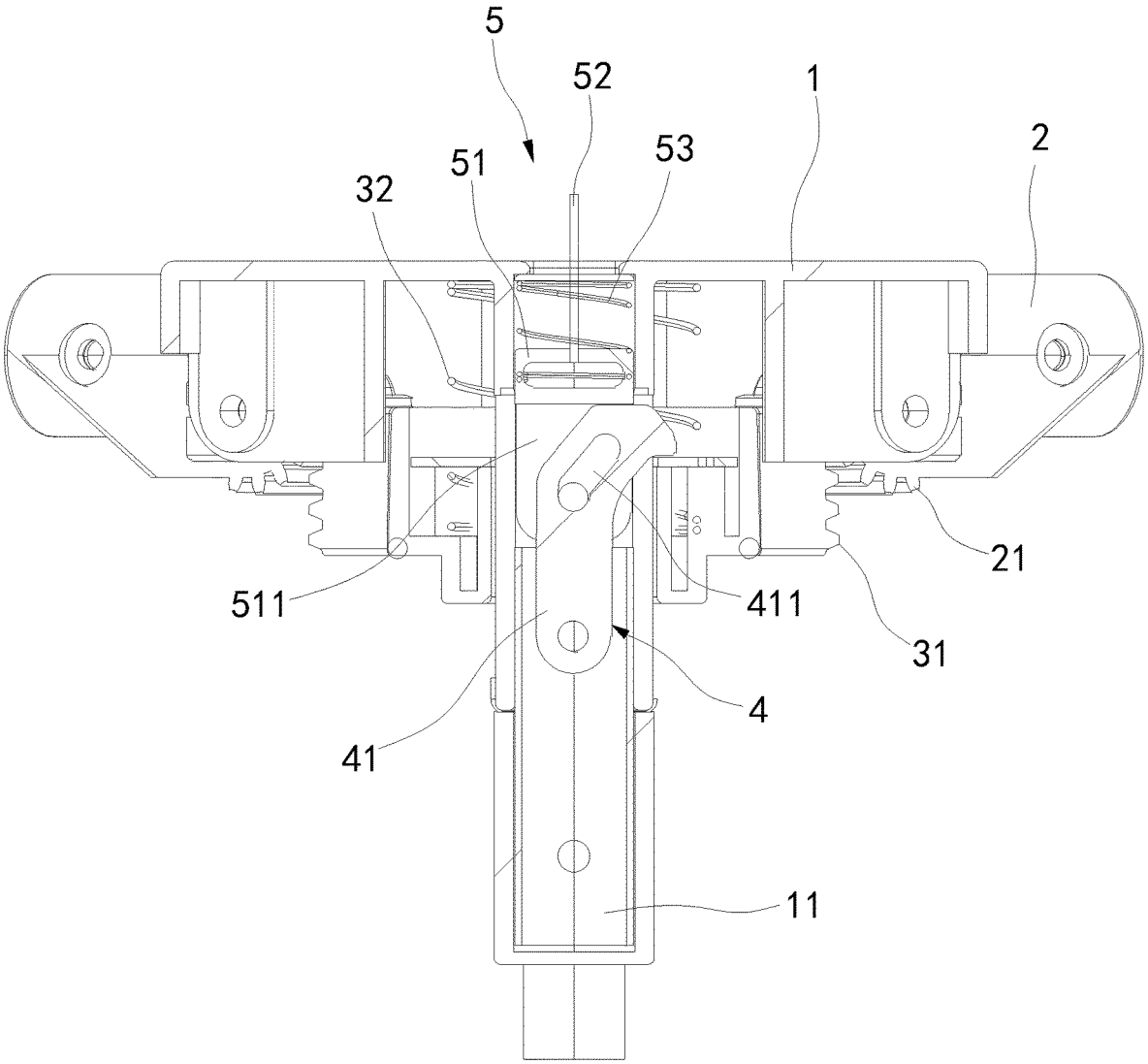
FIG. 4 is a schematic diagram of a structure of a turnover mechanism having a locking member and an unlocking member according to the present invention.

As shown in FIG. 4, a locking member 4 and an unlocking member 5 are further included.

Specifically, the locking member 4 has a locking position and an unlocking position; and when the locking member 4 is in the locking position, the sliding member 3 can be prevented from moving.

The unlocking member 5 is connected to the locking member 4 to switch the locking member 4 between the locking position and the unlocking position.

When folding is needed, the locking member 4 is switched to the unlocking position, the sliding member 3 moves upwards, and therefore the plurality of sets of connecting members 2 are driven to be simultaneously changed from the unfolding state to the folding state through the cooperation of the rack portion 31 and the gear portion 21; and the structure is simple to operate, so that the smooth unfolding is facilitated.

More specifically, an accommodating cavity is formed in the support shaft 11; and the locking member 4 comprises a plurality of rotating pieces 41 rotatably arranged in the accommodating cavity, and the rotating pieces 41 are provided with chutes 411. When the locking member 4 is in the locking position, the rotating piece 41 partially penetrates out of the accommodating cavity to abut against the sliding member 3, so that the sliding member 3 is prevented from moving; and when the locking member is in the unlocking position, the rotating piece 41 can be completely folded into the accommodating cavity.

The unlocking member 5 comprises a blocking piece 51, a lifting portion 52, and a first reset member 53.

The blocking piece 51 is slidably arranged in the accommodating cavity and can be abutted against the rotating piece 41 to prevent the rotating piece 41 from rotating; the blocking piece 51 further has extending portions 511 extending downward and formed at two sides of the rotating piece 41; and a pivot penetrating through the chute 411 is connected between the extending portions 511. The lifting portion 52 is connected to the blocking piece 51 and penetrates out of the top of the central seat 1. The first reset member 53 is connected to the blocking piece 51 to drive the blocking piece 51 to move for resetting, thereby rotating the rotating piece 41 to the locking position.

When the folding is needed, the lifting portion 52 is lifted upwards to drive the blocking piece 52 to move upwards so as to link the rotating piece 41 to rotate, so that the rotating piece 41 is completely folded into the accommodating cavity; and in this case, the sliding member 3 can move along the support shaft 11, so as to drive the connecting member 3 to switch from the unfolding state to the folding state.

It may be understood that the lifting portion 52 may be a flexible belt, a handle, or other structures. This embodiment is not limited thereto.

Embodiment 3

Figure 5:
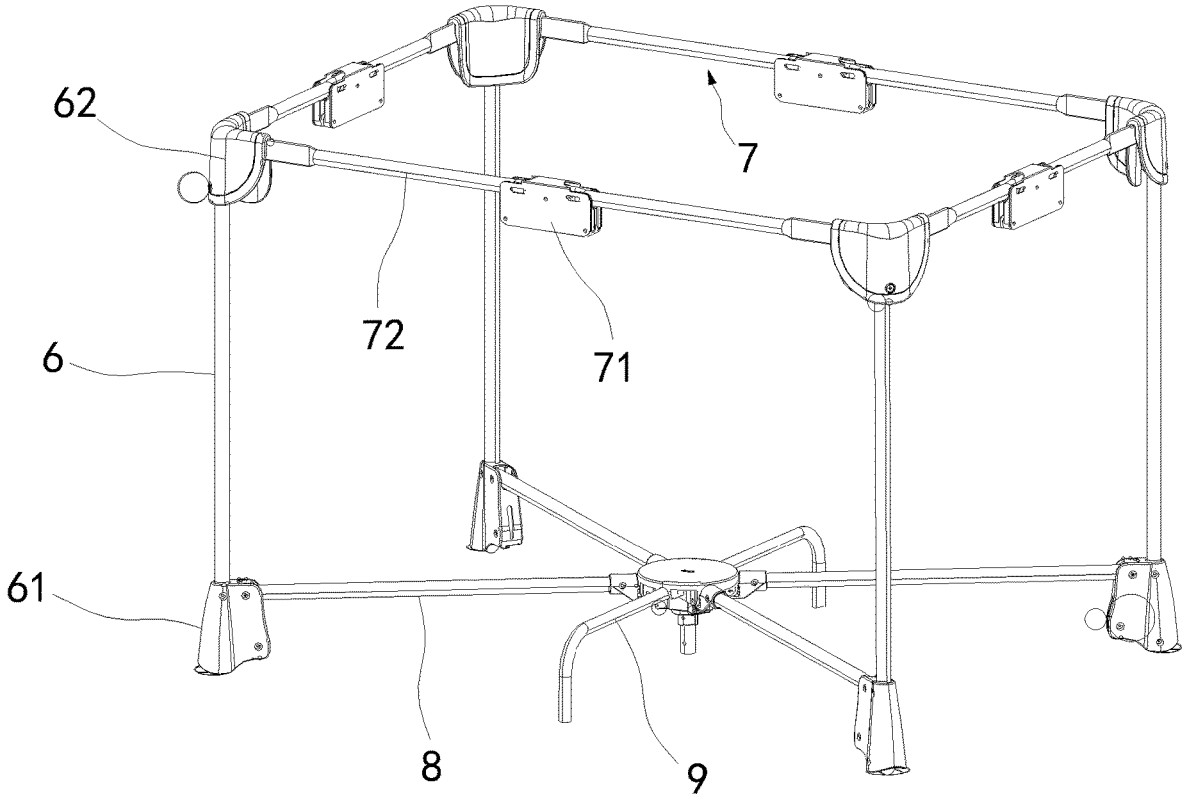
FIG. 5 is a schematic diagram of a structure of a crib frame according to the present invention in a usage state.

As shown in FIG. 5, a crib frame comprises an upright post 6, a handrail folded mechanism 7, a bottom bar 8, the turnover mechanism described in the foregoing embodiments, and other components.

Specifically, four upright posts 6 are distributed in a rectangular shape.

A handrail folded mechanism 7 is connected between the tops of two upright posts 6 to form a rectangular enclosure at an upper portion, wherein the rectangular enclosure comprises a joint 71 and two cross bars 72. One end of the cross bar 72 is pivotally connected to the upright post 6, and the other end of the cross bar is pivotally connected to the connecting member 71.

The connecting members 2 of the turnover mechanism are correspondingly connected to the upright posts 6 one by one; and one end of the bottom bar 8 is hinged to the upright post 6, and the other end of the bottom bar is connected to the connector member 2, so that the turnover mechanism is connected to the crib.

Figure 12:
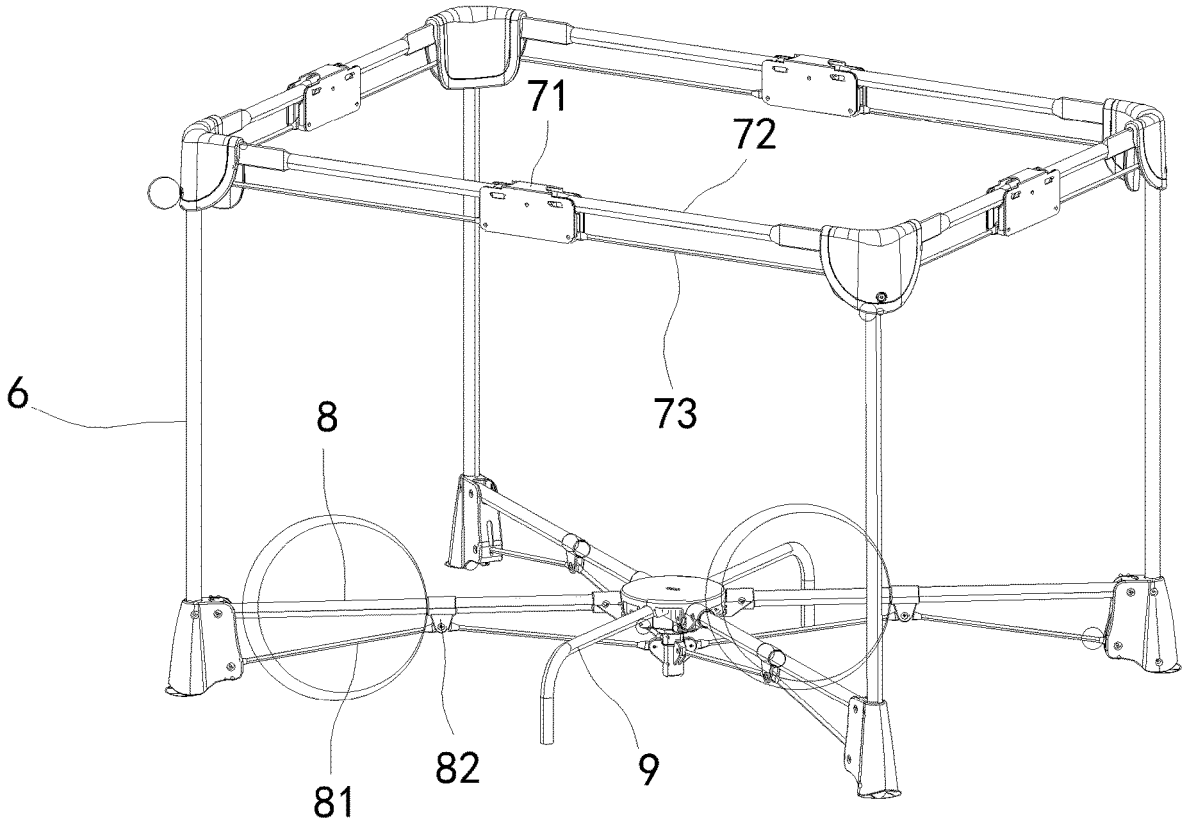
FIG. 12 is a schematic diagram of another structure of a crib frame according to the present invention in a usage state.
Figure 13:
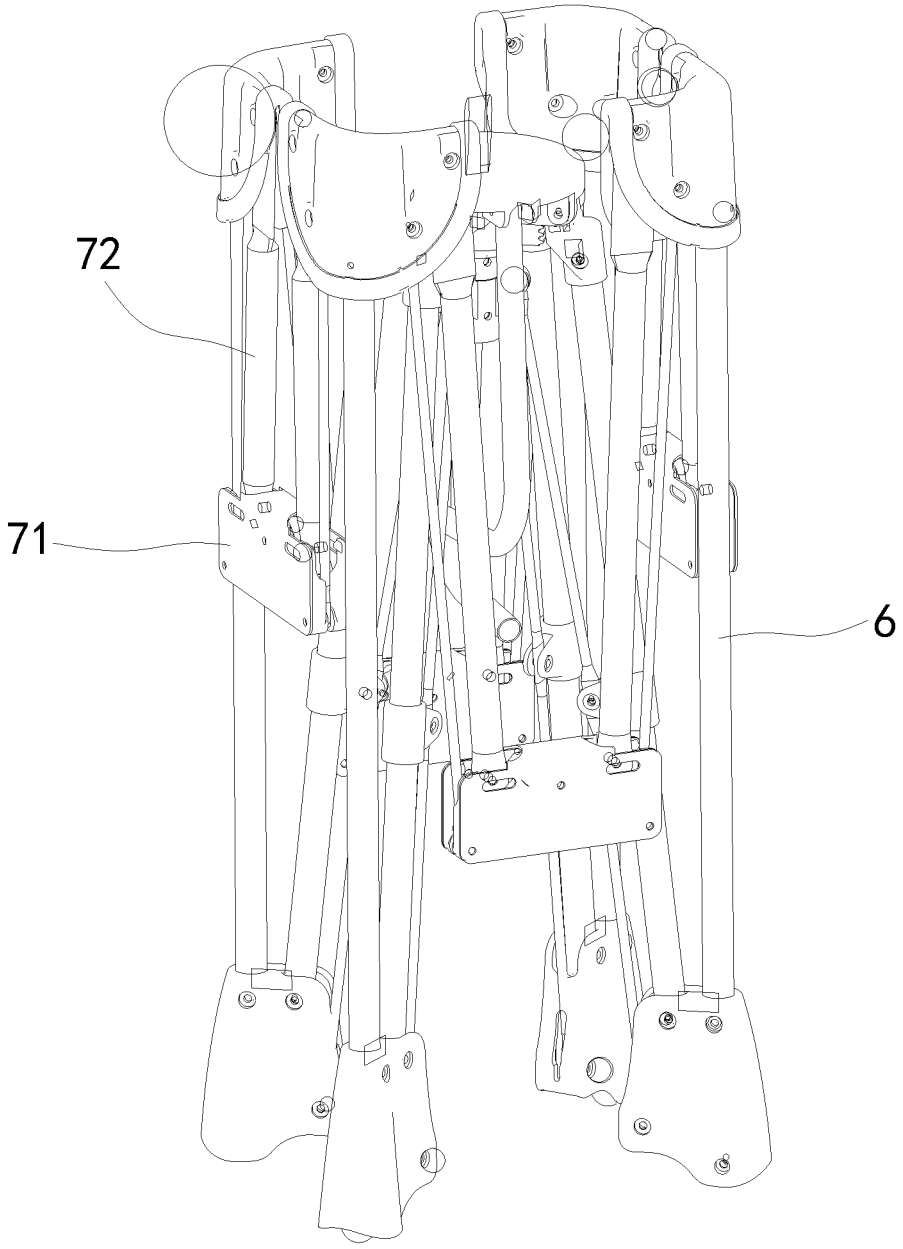
FIG. 13 is a schematic diagram of a structure of a crib frame shown in FIG. 12 in a folding state.

The foldable crib has a usage state as shown in FIG. 12 and a folding state as shown in FIG. 13, and when the crib is in the folding state, the crib has a volume much smaller than that of the usage state, so that the crib can be conveniently transported or stored.

When the crib is folded, the bottom bar 8 is pulled to incline in the upward moving process of the central seat 1, and the upright post 6 is pulled to incline and move in position in the inclining process, so that the cross bar 72 rotates, the crib is folded at one time, and the operation is simple.

More specifically, to improve the stability of the turnover mechanism, the crib frame further comprises 2 auxiliary struts 9, wherein one end of each of the 2 auxiliary struts 9 is hinged to the central seat, and the other end of each of the auxiliary struts forms a free end and is contacted to the ground to support the turnover mechanism.

It may be understood that a number of the auxiliary struts 9 can also be 3, 4, 5, and the like. This embodiment is not limited thereto.

Embodiment 4

Figure 6:
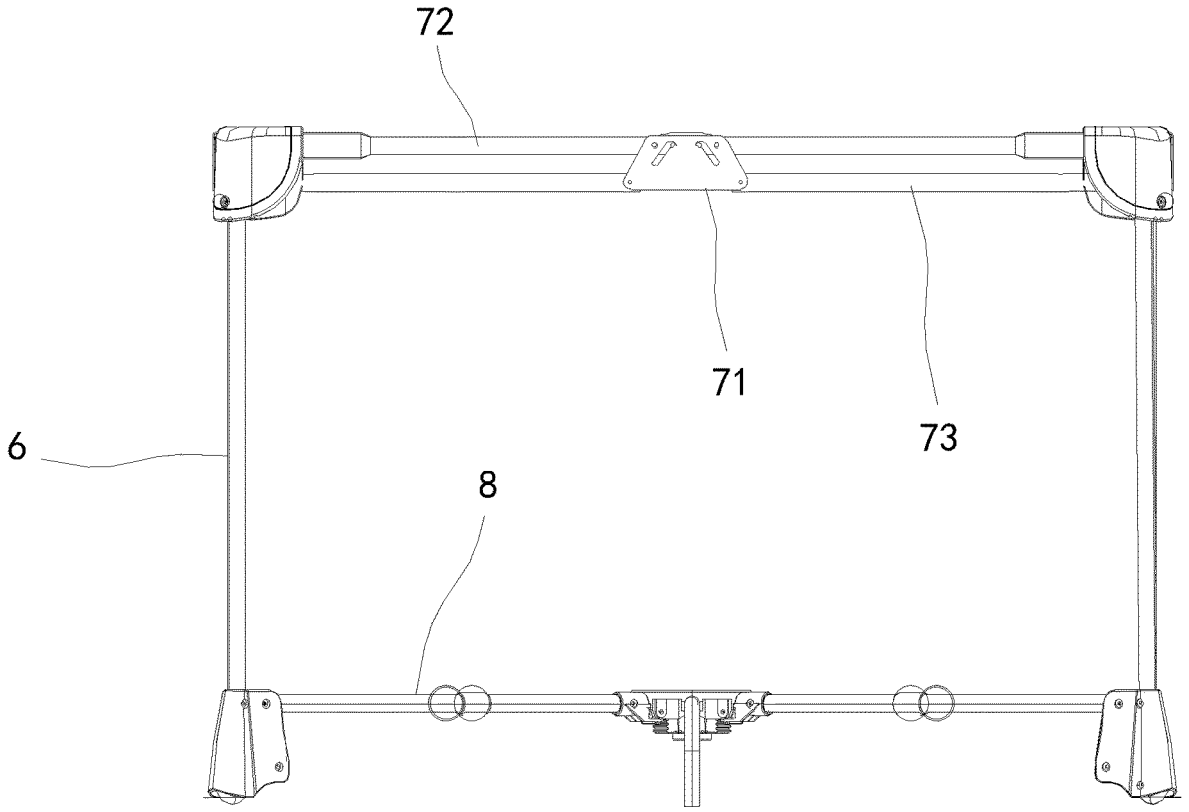
FIG. 6 is a schematic diagram of another structure of a crib frame according to the present invention in a usage state.
Figure 7:
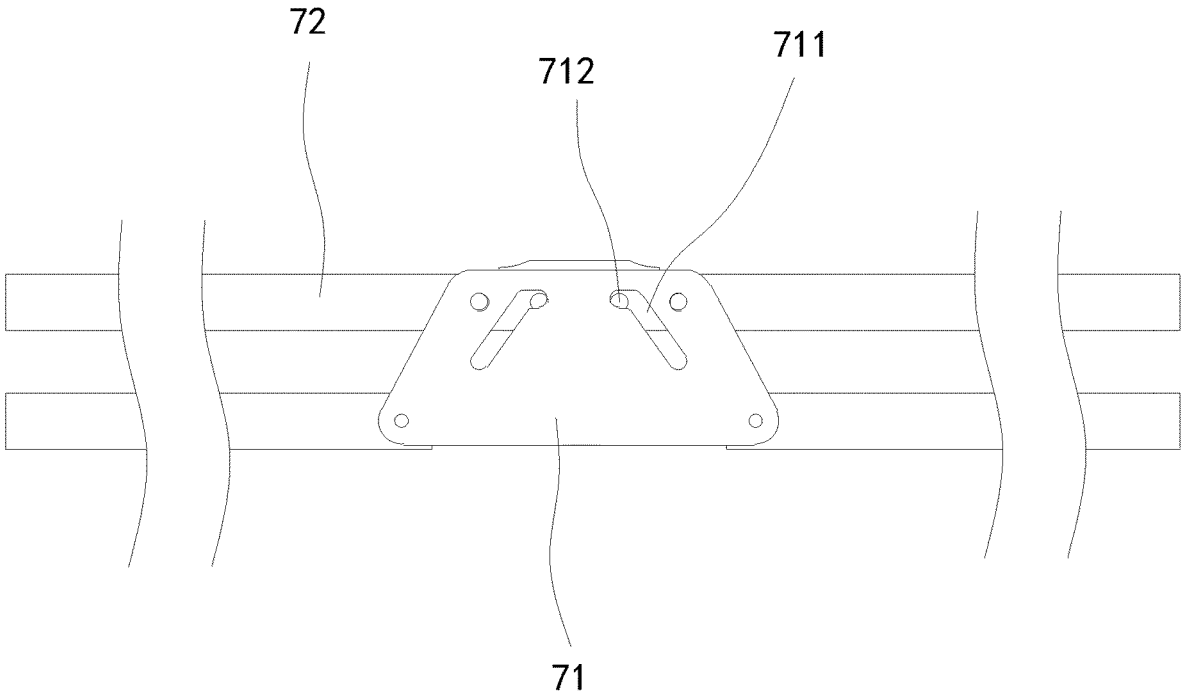
FIG. 7 is a partially enlarged schematic diagram of FIG. 6.

In a specific implementation of Embodiment 3, as shown in FIGS. 6 and 7, two sides of the joint 71 are provided with accommodating cavities used to accommodate the other ends of the cross bars 72; inclined guide grooves 711 are symmetrically provided at two sides of the accommodating cavity; an inclined upper end of the inclined guide groove 711 is provided with a transversely communicated clamping and locking groove 712. Accordingly, the other end of the cross bar 72 is provided with a positioning portion that is engaged with the inclined guide groove 711 and the clamping and locking groove 712, so that the cross bar 72 can only pivot toward a folding state; therefore, when the crib is folded, the bottom bar 8 is pulled to incline in the upward moving process of the central seat 1, and the upright post 6 is pulled to incline and move in position in the inclining process, so that the positioning portion moves from the clamping and locking groove 712 to the inclined guide groove 711, the cross bar 72 rotates, and the crib is folded.

By using the foregoing structure, the strength of the handrail folded mechanism 7 can be improved by the cooperation of the inclined guide groove 711, the clamping and locking groove 712 and the positioning portion, and the phenomenon that the crib is deformed and thus cannot be used due to the rotation of the cross bar 72 when the crib is in the unfolding state is avoided.

It may be understood that the inclined guide groove 711 and the clamping and locking groove 712 penetrate through the joint 71 for easy assembly.

When the crib needs to be unfolded, the central seat 1 is pressed downwards, and the second reset member 42 drives the sliding member 3 to move downwards; the rotating piece 41 penetrates through the accommodating cavity again under the action of the first reset member 53 and abuts against the sliding member 3; and the connecting member 2 rotates under the linkage action of the rack portion 31 and the gear portion 21, so that the bottom bar 8 is driven to correspondingly unfold by taking the central seat 1 as a reference, the upright post 6 is pulled to move, the positioning portion of the cross bar 72 moves from the inclined guide groove 711 to the clamping and locking groove 712 for locking, and the normal use of the crib is ensured.

When the crib needs to be folded, the lifting portion 52 is lifted upwards, so that the blocking piece 51 is linked with the rotating piece 41 to rotate, and the rotating piece 41 is completely accommodated in the accommodating cavity; and the lifting portion 52 is continuously lifted upwards, so that the connecting member 2 is pulled to rotate and the bottom bar 8 is driven to incline in the upward moving process of the central seat 1; the bottom bar 8 pulls the upright post 6 to incline and move in position in the inclining process, so that the positioning portion of the cross bar 72 moves from the clamping and locking groove 712 to the inclined guide groove 711 to rotate, the crib is changed from the usage state to the folding state, and the one-time folding and unfolding of the crib is completed.

Figure 8:
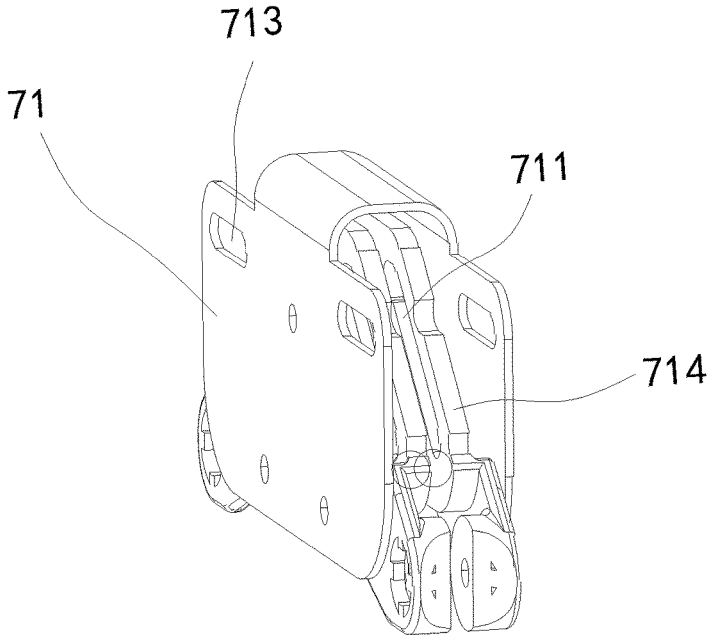
FIG. 8 is a schematic diagram of a structure of a joint according to the present invention.
Figure 9:
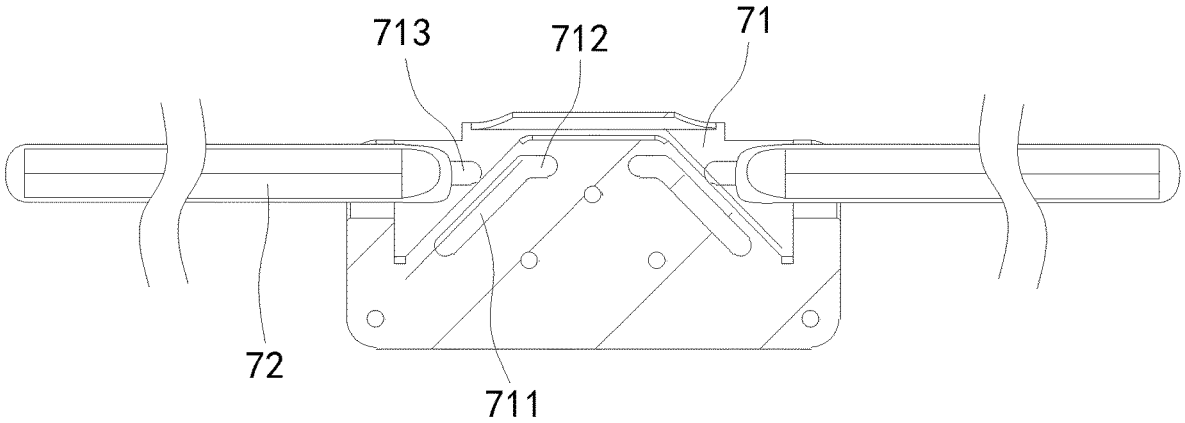
FIG. 9 is a schematic diagram of a structure of a handrail folded mechanism having the joint shown in FIG. 8 according to the present invention.

More specifically, in some embodiments, to improve the strength of the joint 71, as shown in FIGS. 8 and 9, two sides of the accommodating cavity of the joint 71 are provided with reinforcing rib plates 714, and a gap is formed between the reinforcing rib plates 714; wherein the inclined guide groove 711 and the clamping and locking groove 712 are arranged on one surface that is of the reinforcing rib plate 714 and that is opposite to the other reinforcing rib plate; and two sides of the accommodating cavity are further symmetrically provided with horizontal guide grooves 713. Accordingly, the other end of the cross bar 72 is provided with a pivot shaft penetrating through the horizontal guide groove 713.

Embodiment 5

Figure 10:
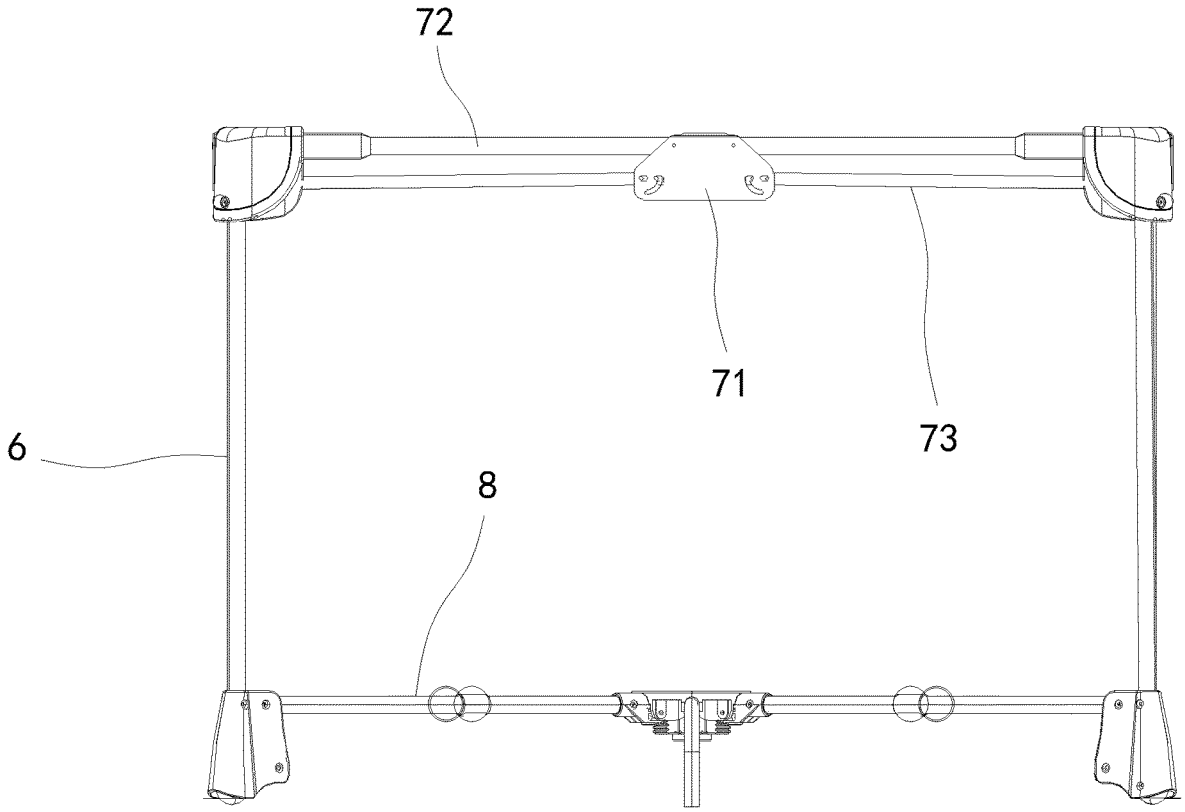
FIG. 10 is a schematic diagram of another structure of a crib frame according to the present invention in a usage state.

As shown in FIG. 10, the handrail folded mechanism 7 further comprises a first balance bar 73 arranged below the cross bar 71.

Figure 11:
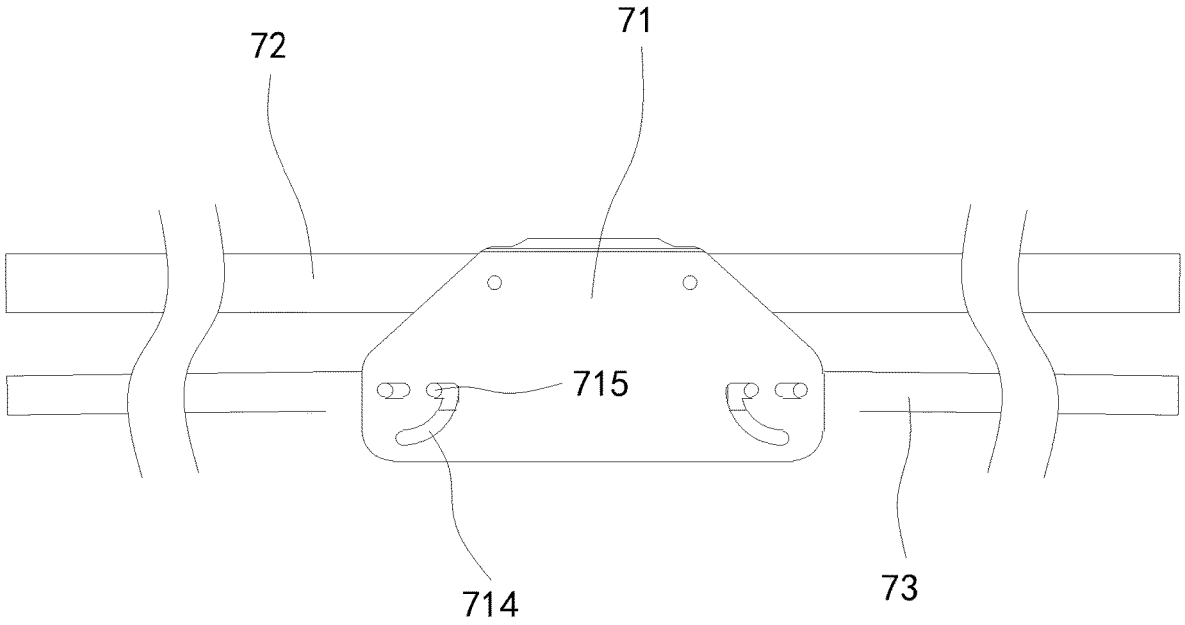
FIG. 11 is a partially enlarged schematic diagram of FIG. 10.

More specifically, as shown in FIG. 11, the joint 71 is provided with an arc-shaped guide groove 715; and an upper end of the arc-shaped guide groove 715 is provided with a transversely communicated limiting groove. One end of the first balance bar 73 is hinged to the upright post 6, and the other end of the first balance bar is provided with a pivot movably penetrating through the arc-shaped guide groove 715 or the limiting groove.

When the crib is folded, the upright post 6 pulls the pivot of the first balance bar 73 to move from the limiting groove to the arc-shaped guide groove 715 to rotate in the process of inclining and moving the position, and drives the cross bar 72 to rotate, so that the crib is changed from the usage state to the folding state, and the one-time folding and unfolding of the crib is completed.

Embodiment 6

Figure 14:
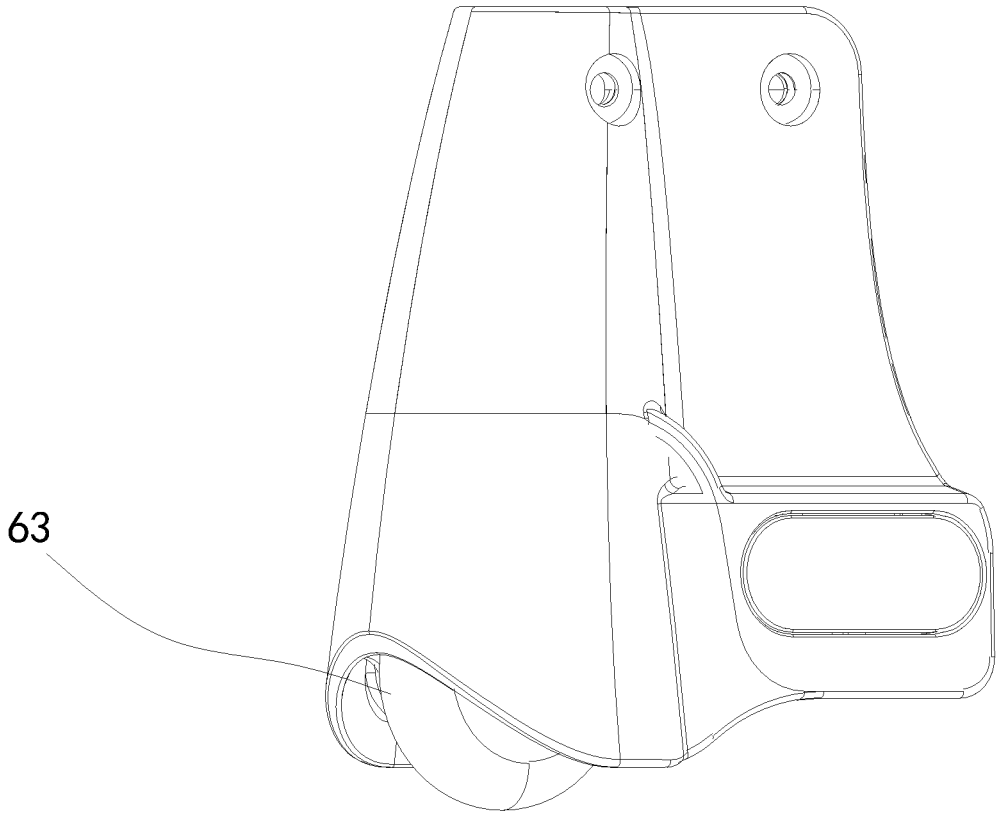
FIG. 14 is a schematic diagram of a structure of a caster of a crib frame according to the present invention.

In this embodiment, as shown in FIGS. 5 and 14, a support foot 61 may be formed at a lower portion of the upright post 6, and one end of the bottom bar 8 is hinged to the support foot 6 to connect to the upright post 6. The support feet 61 are integrally formed with the upright posts 6 or are connected to the upright posts 6 by rivets. It may be understood that the support feet 61 may be connected to the upright posts 6 in other manners. This embodiment is not limited thereto.

Considering that the support feet 61 are not movable, which causes inconvenience in movement when the crib needs to be moved, casters 63 may be formed at the lower portions of the upright posts 6, or the casters 63 may be formed at two of the four upright posts 6, and the support feet 61 are formed at the other two upright posts, so as to facilitate the movement of the crib.

It may be understood that the casters 63 are further provided with a brake mechanism, so that when the caster does not need to be moved, the casters can be fixed through the brake mechanism, and the safety of the crib is improved. The brake mechanism can use existing technology, which does not present any difficulty for those skilled in the art, and will not be described in detail here.

More specifically, a top of the upright post 6 is provided with a corner seat 62, one end of the cross bar 72 is hinged to the corner seat 62, and the other end of the cross bar is hinged to the joint 71.

Embodiment 7

In a specific implementation of the foregoing embodiment, to improve the stability of the crib, as shown in FIG. 12, a second balance bar 81 is provided below the bottom bar 8, one end of the second balance bar 81 is hinged to the upright post 6, and the other end of the second balance bar is hinged to the support shaft 11.

More specifically, the second balance bar 81 is provided in a plurality of sections and connected to the bottom bar 8 by a movable buckle 82, so that the flexibility of the second balance bar 81 can be improved, which is beneficial to improving the folding efficiency.

The objectives, technical solutions and beneficial effects of the present invention are further explained in detail with reference to the specific implementations described above, and it should be understood that the above-mentioned contents are merely specific implementations of the present invention, and are not intended to limit the protection scope of the present invention. Any modification, equivalent substitution, improvement, etc., made within the spirit and principle of the present invention shall all fall within the protection scope of the present invention.

The invention claimed is:

1. A turnover mechanism having an unfolding state and a turnover state, comprising:

a central seat of which a center of a bottom is provided with a support shaft;

a plurality of sets of connecting members arranged around the central seat and pivotally connected to the central seat, wherein a gear portion is provided at one end that is of the connecting member and that is pivotally connected to the central seat;

a sliding member sleeved on the support shaft and moving up and down along the support shaft, wherein the sliding member is provided with a rack portion engaged with the gear portion;

a locking member having a locking position and an unlocking position, wherein when in the locking position, the locking member can prevent the sliding member from moving, and when in the unlocking position, the sliding member can move along the support shaft; and an unlocking member connected to the locking member so as to switch the locking member between the locking position and the unlocking position, wherein the support shaft has an accommodating cavity, and wherein the locking member comprises:

a plurality of rotating pieces centrally symmetrically arranged inside the support shaft and pivotally connected to the support shaft, wherein when in the locking position, the rotating piece partially penetrates through the support shaft and abuts against the sliding member, and wherein when in the unlocking position, the rotating piece can rotate under the action of the unlocking member and be completely accommodated in the accommodating cavity.

2. The turnover mechanism according to claim 1, wherein the unlocking member comprises:

a blocking piece slidably mounted in the accommodating cavity and abutting against a side surface of a top of the rotating piece so as to prevent the rotating piece from rotating;

a lifting portion arranged at the top of the central seat, penetrating through the top of the central seat and connected to the blocking piece; and a first reset member connected to the blocking piece;

wherein the blocking piece extends downwards along two sides of the rotating piece to form extending portions;

the rotating piece is provided with a chute; and the chute is provided with a pivot in a penetrating mode, and two ends of the pivot are connected to the extending portion, respectively.

3. The turnover mechanism according to claim 2, comprising a second reset member connected to the sliding member.

4. A crib frame, having a usage state and a folding state and comprising an upright post and a handrail folded mechanism connected to the upright post, wherein the crib frame further comprises:

the turnover mechanism according to claim 1 and a bottom bar connecting the turnover mechanism and the upright post;

wherein the connecting members correspond to the upright posts one by one; and one end of the bottom bar is hinged to the upright post, and the other end of the bottom bar is connected to the connecting member.

5. The crib frame according to claim 4, wherein the handrail folded mechanism comprises:

a joint; and two cross bars, wherein one end of the cross bar is pivotally connected to the upright post, and the other end of the cross bar is pivotally connected to the connecting member;

wherein the cross bar can change the crib frame from a usage state to a folding state under the action of the turnover mechanism.

6. The crib frame according to claim 5, wherein two sides of the joint are provided with accommodating cavities used to accommodate the other ends of the cross bars;

inclined guide grooves are symmetrically provided at two sides of the accommodating cavity;

an inclined upper end of the inclined guide groove is provided with a transversely communicated clamping and locking groove;

the other end of the cross bar is provided with a positioning portion that can move in the inclined guide groove and the clamping and locking groove;

when the crib frame needs to be folded, the upright post can pull the positioning portion from the clamping and locking groove to the inclined guide groove in an inclining process so as to rotate the cross bar, so that a foldable crib can be changed from the usage state to the folding state.

7. The crib frame according to claim 6, wherein two sides of the accommodating cavity are provided with reinforcing rib plates, and the inclined guide groove and the clamping and locking groove are arranged at one surface that is of the reinforcing rib plate and that is opposite to the other reinforcing rib plate.

8. The crib frame according to claim 7, wherein two sides of the accommodating cavity are further symmetrically provided with horizontal guide grooves; and the other end of the cross bar is provided with a pivot shaft, and the pivot shaft penetrates through the horizontal guide groove.

9. The crib frame according to claim 5, wherein a first balance bar is provided below the cross bar; and one end of the first balance bar is hinged to the upright post, and the other end of the first balance bar is hinged to the joint.

10. The crib frame according to claim 9, wherein the joint is provided with an arc-shaped guide groove; an upper end of the arc-shaped guide groove is provided with a transversely communicated limiting groove; and the other end of the first balance bar is provided with a pivot that is movable and penetrates through the arc-shaped guide groove or the limiting groove.

11. The crib frame according to claim 4, wherein a second balance bar is provided below the bottom bar, one end of the second balance bar is hinged to the upright post, and the other end of the second balance bar is hinged to the support shaft.

12. The crib frame according to claim 11, wherein the second balance bar is provided in a plurality of sections and connected to the bottom bar by a movable buckle.

13. The crib frame according to claim 4, wherein a caster is formed at a lower end of the upright post.

14. The crib frame according to claim 4, further comprising a plurality of auxiliary struts; and one end of the auxiliary strut is hinged to the central seat, and the other end of the auxiliary strut is formed into a free end.

15. A foldable crib, having the crib frame according to claim 4.

* * * * *